US009138072B1

(12) United States Patent
Sanders et al.

(10) Patent No.: US 9,138,072 B1
(45) Date of Patent: Sep. 22, 2015

(54) ADJUSTABLE HEIGHT AND MULTI-PURPOSE NURSING PILLOW

(71) Applicants: Natalie C. Sanders, Salinas, CA (US); Glen Sanders, Salinas, CA (US)

(72) Inventors: Natalie C. Sanders, Salinas, CA (US); Glen Sanders, Salinas, CA (US)

( * ) Notice: Subject to any disclaimer, the term of this patent is extended or adjusted under 35 U.S.C. 154(b) by 2 days.

(21) Appl. No.: 14/255,823

(22) Filed: Apr. 17, 2014

(51) Int. Cl.
*A47D 13/08* (2006.01)
*A47G 9/10* (2006.01)
*A47G 9/02* (2006.01)

(52) U.S. Cl.
CPC ..... *A47D 13/083* (2013.01); *A47G 9/0238* (2013.01); *A47G 9/0253* (2013.01); *A47G 9/10* (2013.01); *A47G 2009/1018* (2013.01)

(58) Field of Classification Search
CPC A47G 9/10; A47G 9/0253; A47G 2009/1018
USPC ..... 5/655, 657, 652, 640, 645, 636, 490
See application file for complete search history.

(56) References Cited

U.S. PATENT DOCUMENTS

| | | | | | |
|---|---|---|---|---|---|
| 3,148,389 | A * | 9/1964 | Lustig | 5/645 |
| 4,780,921 | A * | 11/1988 | Lahn et al. | 5/630 |
| D318,202 | S * | 7/1991 | Weber | D6/601 |
| 5,029,351 | A * | 7/1991 | Weber | 5/655 |
| 5,448,790 | A * | 9/1995 | Saro et al. | 5/657 |
| 5,528,784 | A * | 6/1996 | Painter | 5/640 |
| 5,581,833 | A * | 12/1996 | Zenoff | 5/655 |
| 5,642,543 | A * | 7/1997 | Huntley | 5/640 |
| 5,953,777 | A * | 9/1999 | Buck | 5/636 |
| 5,987,676 | A * | 11/1999 | Littleford et al. | 5/636 |
| 6,061,854 | A | 5/2000 | Crowley | |
| 6,564,408 | B2 * | 5/2003 | Van Vuuren | 5/655 |
| 6,671,906 | B1 * | 1/2004 | Milligan | 5/636 |
| 7,127,759 | B2 * | 10/2006 | Koops | 5/644 |
| 7,454,808 | B2 * | 11/2008 | Parrilla | 5/655 |
| 7,703,159 | B2 * | 4/2010 | Parrilla | 5/655 |
| 7,716,765 | B1 * | 5/2010 | Lakov | 5/655 |
| 8,166,587 | B2 * | 5/2012 | Collins | 5/655 |
| 8,418,295 | B2 * | 4/2013 | Clark | 5/655 |
| 8,590,078 | B1 * | 11/2013 | Zenoff | 5/655 |
| 2002/0023301 | A1 * | 2/2002 | Vuuren | 5/655 |
| 2004/0006822 | A1 * | 1/2004 | Milligan | 5/636 |
| 2005/0172409 | A1 * | 8/2005 | Koops | 5/636 |
| 2005/0235425 | A1 * | 10/2005 | Parrilla | 5/655 |
| 2006/0265809 | A1 * | 11/2006 | Wagner | 5/655 |
| 2009/0007338 | A1 * | 1/2009 | Parrilla | 5/655 |
| 2009/0199343 | A1 * | 8/2009 | Collins | 5/655 |
| 2011/0119833 | A1 * | 5/2011 | Clark | 5/655 |
| 2014/0359947 | A1 * | 12/2014 | Turner | 5/655 |
| 2015/0101125 | A1 * | 4/2015 | Fang | 5/655 |

* cited by examiner

*Primary Examiner* — Robert G Santos
(74) *Attorney, Agent, or Firm* — Thomas Schneck

(57) ABSTRACT

A height adjustable nursing pillow includes a cushion case and a select number of cushions, the cushion case having an elasticized side panel allowing the cushion case to conform to a height of any number of the select number of cushions within the cushion case. A nursing mother is able to adjust the height of the nursing pillow to a height that is comfortable to her by adding or removing cushions from the cushion case while the cushion case is stretched or relaxed to change its height to conform to the height of any number of the select number of cushions used. In one embodiment, the cushions themselves are used outside of the cushion case as a baby support and are each covered with a washable and removable cover preventing a baby from being able to contact the underlying cushion material.

13 Claims, 6 Drawing Sheets

ADJUSTABLE HEIGHT AND MULTI-PURPOSE NURSING PILLOW

TECHNICAL FIELD

The field of the invention pertains, in general to nursing pillows, and more specifically to adjustable height nursing pillows.

BACKGROUND

Nursing pillows of a contoured shape provide a support for a baby being nursed and encompass a torso of a nursing mother to make nursing a more comfortable experience. One disadvantage of some prior art nursing pillows is that they lack an ability to adjust the height of the pillow. An adjustable height pillow allows nursing mothers to select a height that is most comfortable to them as they nurse.

U.S. Pat. No. 6,061,854 to Crowley provides an adjustable height pillow assembly that includes lap cushions insertable within a cover to determine a height of the pillow assembly. A different number of lap cushions are inserted within the cover depending on the size of the nursing mother to adjust the height of the pillow assembly. The cover is sized to accommodate the largest of the pillow configurations that may be obtained by inserting lap cushions into the pillow cover so the cover may be oversized when a minimum number of lap cushions is used. The cover may be folded along one side and fasteners, such as snap assemblies, hook and loop fasteners, fabric ties or elastic bands, are used to maintain the cover in a folded configuration. A disadvantage in the fastener configuration is that it involves an extra step and extra accessories for the nursing mother to size the pillow cover.

What is desired is a new and improved adjustable height nursing pillow.

OBJECTS

It is an object of the present invention to provide a new and improved nursing pillow.

It is another object of the present invention to provide a pillow that conforms to changes in cushion height.

It is another object of the present invention to provide a multi-purpose nursing pillow.

SUMMARY

The present invention is a nursing pillow comprising a cushion case and a select number of cushions, the cushion case having an elasticized side panel allowing the cushion case to conform to a height of any number of the select number of cushions within the cushion case. In this manner the cushion case will not have material that is overhanging, nor will it be of a height that is too short to accommodate all of the select number of cushions. The cushions and the cushion case comprise a contoured peripheral portion for accommodating some of the mid-section of a torso of a nursing mother. The nursing mother is able to adjust the height of the nursing pillow to a height that is comfortable to her as the cushion case is stretched or relaxed in the side panel to change its height to conform to the height of and to receive any number of the select number of cushions.

In one embodiment, the cushions themselves are each covered with a washable and removable cover. The cushion cover prevents a baby or small child from being able to contact the underlying cushion material, typically foam, which may pose a choke or other hazard when the cushions are removed from the cushion case.

The cushions may be arranged by a user in any of a number of different configurations outside of the cushion case to provide a cushioned support for a baby or child. In one example, the cushions include four cushions with two of the four cushions comprising a wedge shaped cross section and the other two comprising a rectangular shaped cross section. The two cushions having a wedge shape cross section are arranged on top of one another to provide an inclined cushion structure. A first of the cushions having a rectangular cross section is arranged adjacent to the inclined surface structure and a second of the cushions having a rectangular cross section is arranged adjacent to the first cushion having a rectangular cross section. This arrangement allows a child or baby to rest on the structure, typically with his or her head closest to the inclined structure providing elevation to the head. It is also provides an arrangement that allows a baby "tummy time" to help with for example, acid reflux problems or to strengthen the muscles of a baby.

In one embodiment the nursing pillow includes a lumbar cushion connected by straps to the cushion case. The lumbar pillow provides support to a mother's back while she is nursing.

DETAILED DESCRIPTION

Figure 1:
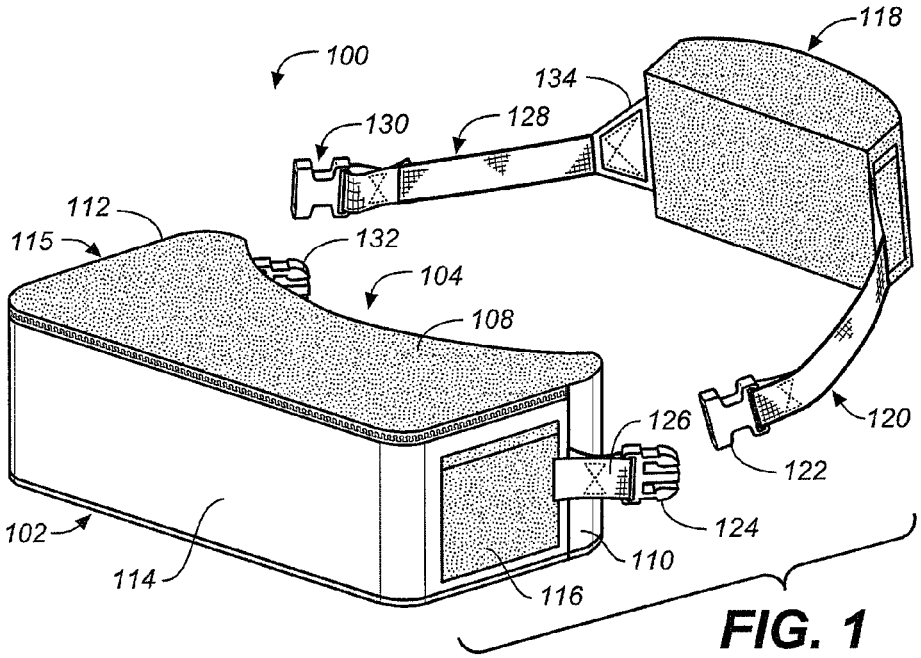
FIG. 1 is a front perspective view of the nursing pillow of the present invention.
Figure 2:
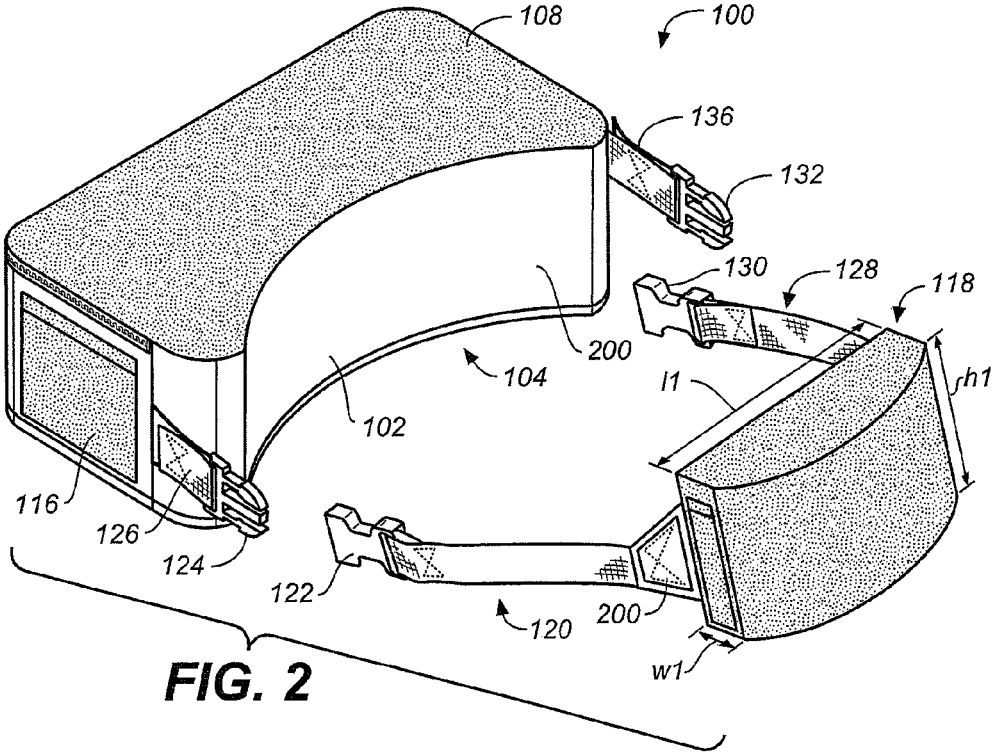
FIG. 2 is a rear perspective view of the nursing pillow of the FIG. 1.
Figure 3:
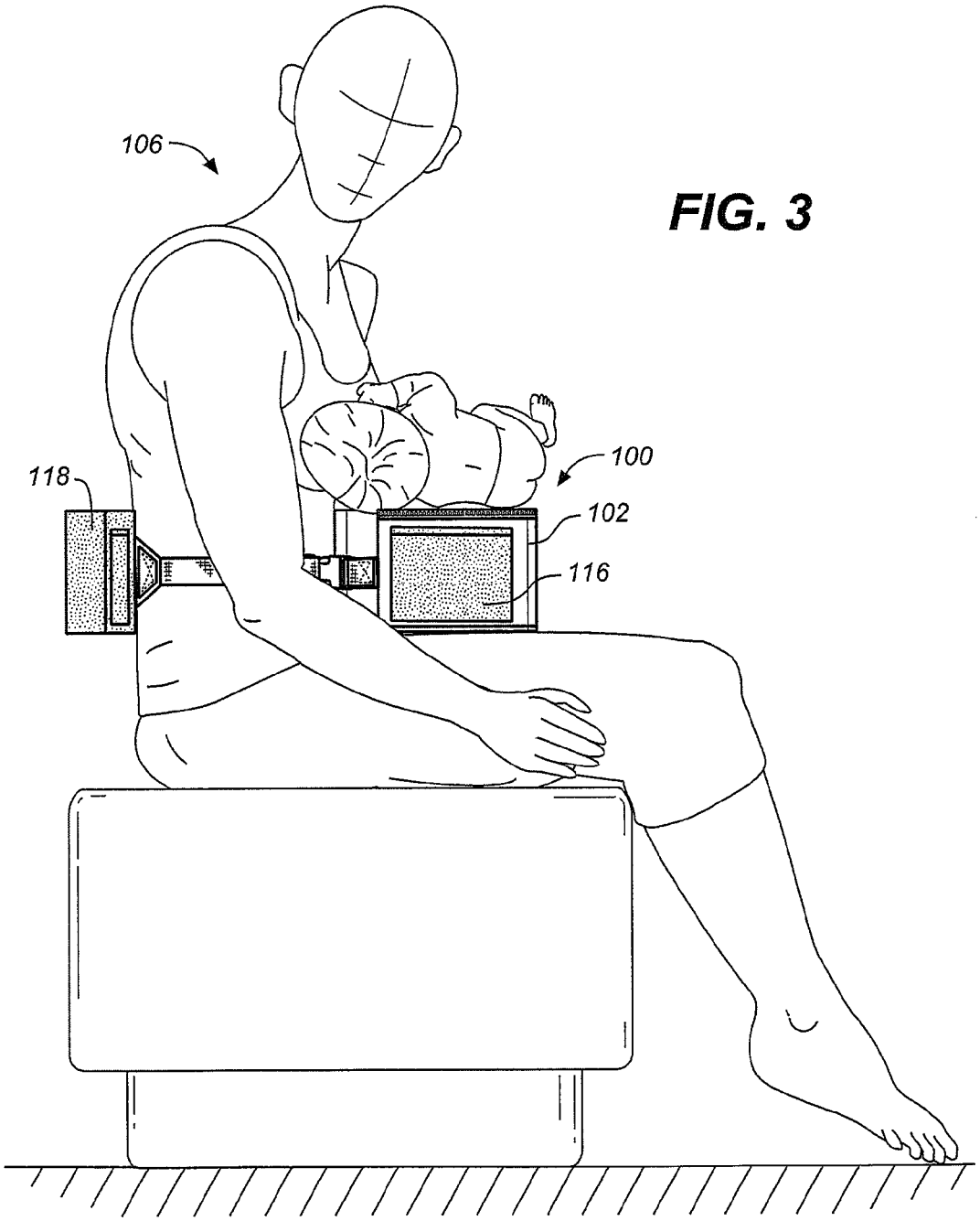
FIG. 3 is a perspective view of a nursing mother using the pillow of FIG. 2.

With reference to FIGS. 1-3, there is seen a nursing pillow 100 of the present invention featuring an elasticized side panel 102. The pillow comprises a contoured peripheral portion 104 that is sized to receive a portion of the mid-section of a torso of a nursing mother 106, as seen in FIG. 3. The nursing pillow 100 includes a cushion case 115 with a top surface 108, a bottom surface (not shown), and the elasticized side panel 102 about the perimeter of the pillow. The elasticized side panel 102 includes a left side surface 110, a right side surface 112, a front surface 114 and a rear surface 200 with which the contoured portion 104 is formed. The elasticized side panel 102 allows the nursing pillow 100 to be adjustable in height to conform to any number of a select number of cushions 400 (FIG. 4) disposed within the cushion case 115. Some or all portions of the surfaces of the side panel 102 may be elasticized. The elasticized panel may comprise, for example, lycra or spandex. A baby rests on the top surface 108 while nursing, as seen in FIG. 3.

Still referring to FIGS. 1-3, in one embodiment, the nursing pillow 100 further comprises a side storage pocket 116 disposed on the left side surface 110. The side pocket 116 may be used to store items such as baby items such as wipes, toys binkies and teethers (not shown).

Figure 5:
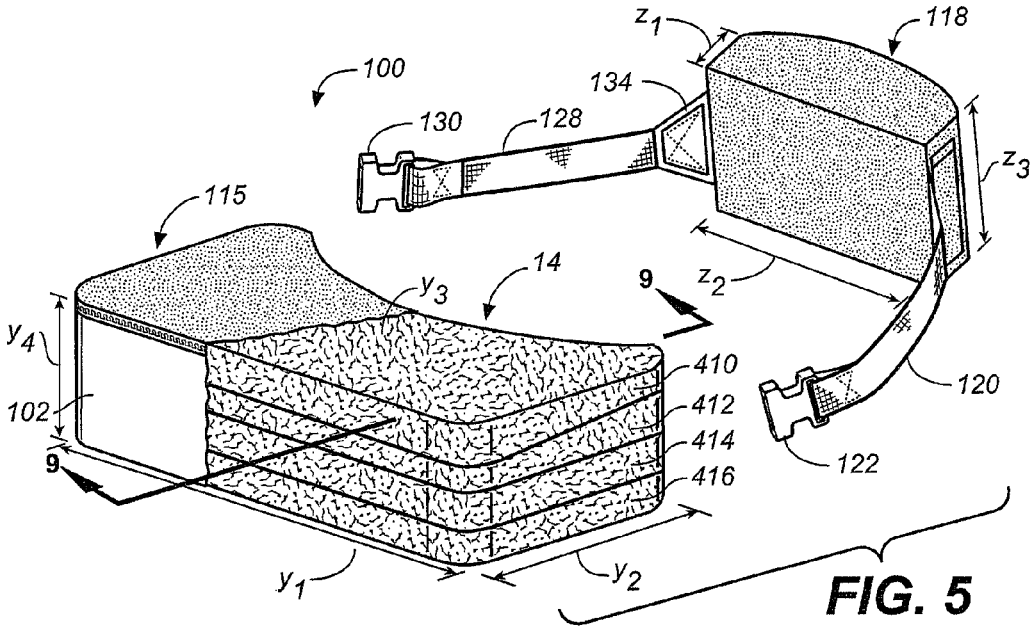
FIG. 5 is a partial cutaway view of the nursing pillow of FIG. 1.

Referring to FIGS. 1, 2 and 5, the nursing pillow 100 may also comprise a lumbar pillow 118 attached to the cushion case 115 by straps and buckles, such as side squeeze plastic buckles. In one example, the lumbar pillow has a width $z_1$ of 3 inches, a length $z_2$ of 9.5 inches and a height $z_3$ of 5.5 inches. Extending from one side of the lumbar pillow is a strap 120 with a buckle receiver 122 at one end configured to mate with a male buckle member 124 extending from the left side 110 via strap 126. The strap 120 includes a strap pocket 200 within which a loose end of the strap 120 may be tucked in if the lumbar pillow 118 is not in use. Extending from another side of the lumbar pillow 118 is a strap 128 with a buckle receiver 130 at one end configured to mate with a male buckle member 132 extending from the right side 112 via strap 136. The strap 138 includes a strap pocket 134 within which a loose end of the strap 128 may be tucked in if the lumbar pillow is not in use. When buckled to the cushion case 115 with cushions, the lumbar pillow 118 is secured behind the nursing mother to provide back support to the nursing mother. The lumbar pillow 118 may or may not have a cover.

Figure 4:
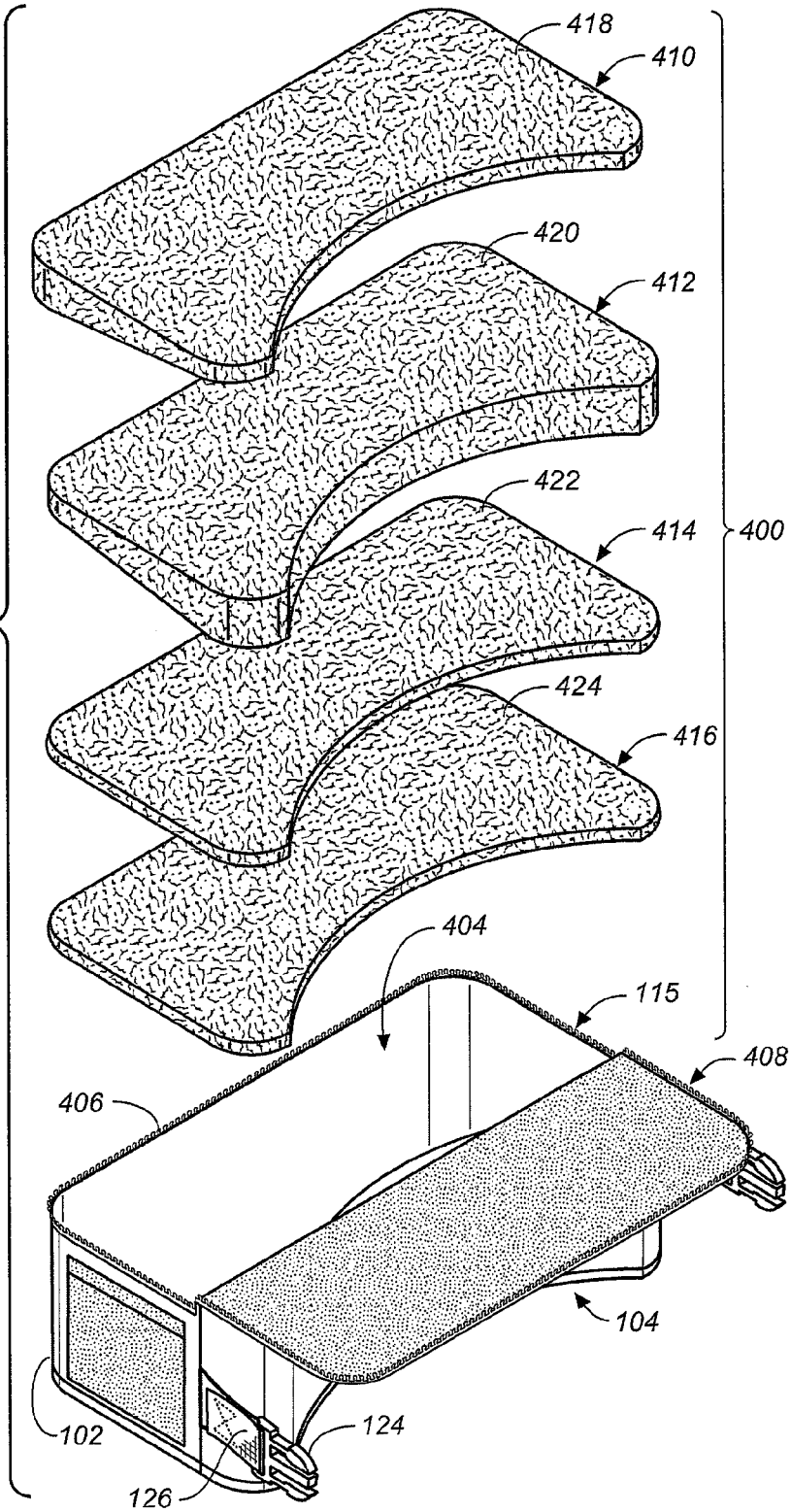
FIG. 4 is an exploded view of the nursing pillow of FIG. 1.

With reference to FIG. 4, an open configuration of the cushion case 115 is seen. Cushion case 115 is collapsible and is typically not rigid, however, for purposes of illustration and to highlight a cushion pocket 404 which it has, it is depicted as being rigid. The cushion case 115 comprises, for example, a soft material or fabric which is washable, in addition to the elasticized material of the side panel 102. In one embodiment, the cushion case 115 comprises all of the same material. For example the material is cotton, terrycloth, and/or an elasticized material. As described above, the side panel 102 may be elasticized. The cushion case 115 includes an opening 406 within which any number of the select number of cushions 400 is inserted, as seen in FIG. 5. The cushion case 115 includes, for example, a zipper 408 or other type of fastener to close the cover member 409 over the cushion case opening.

Still referring to FIG. 4, the select number of cushions 400 shown is four although the select number may be greater or less than four. The cushions 410, 412, 414, and 416, in one example, are comprised of foam. Four cushions or less are insertable within the cushion case pocket. The zipper 408 is used to close the top surface 108 of the cushion case over the pocket opening 406. The elasticized side panel 102 conforms its height to a height of any number of the height select number of cushions by expanding or contracting with its elasticized material.

Figure 9:
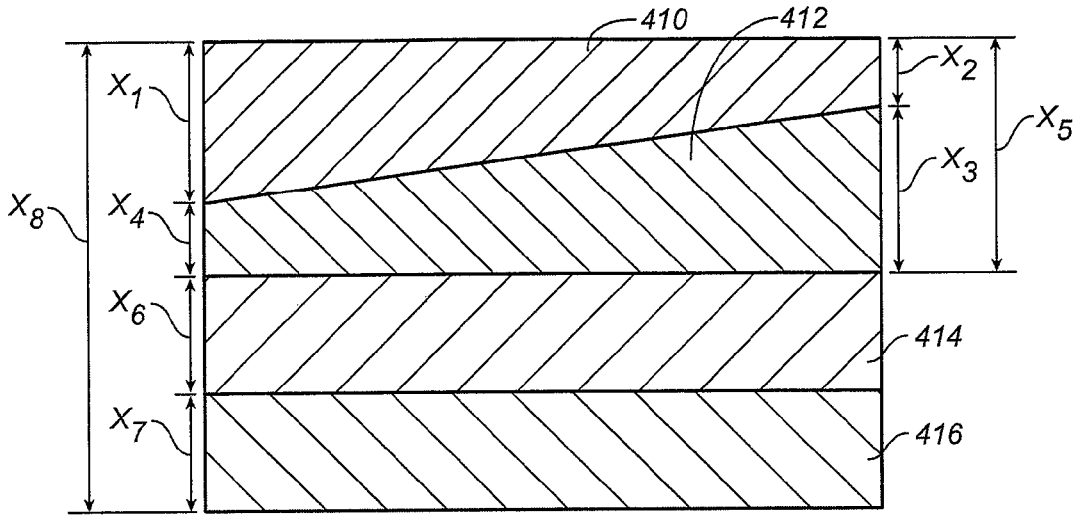
FIG. 9 is a partial side cross sectional view of the cushions of FIG. 5.

In FIGS. 5 and 9, a stack of cushions comprising cushions 410, 412, 416 and 418 is seen formed within the cushion case 115. The cushions have for example, length and peripheral portion dimensions substantially the same as the corresponding cushion case 115 dimensions so that each cushion may fit within the cushion case 115. In one example, the cushion case 115 has a length $y_1$ of 19 inches, a width $y_2$ at its longest section of 10 inches, a width $y_3$ at its shortest section of 7 inches and a height $y_4$ of 5.75 inches. The number of cushions stacked within the cushion case 115 varies dependent upon the number of cushions the nursing mother selects to have stacked within the cushion case 115. The nursing mother may select any number of cushions from the select number of cushions (here, four is the select number of cushions) to achieve a height of the nursing pillow 100 that is most comfortable to her. Because the side panel 102 of the cushion case is elasticized, it expands (for example when the user pulls on it) and/or contracts in height to conform to a height of any number of the select number of cushions. There is thus little or no overhang when using less than all of the select number of cushions.

In use, a nursing mother inserts a desired number of select cushions in the cushion case to achieve a desired height of the nursing pillow 100. In order to fit the desired number of select cushions in the cushion case, a nursing mother may be required to pull on the cushion case 115 or side panel 102 to stretch the side panel 102 and expand the height of the side panel 102 to cover the cushions and close the opening. In one example, when all four cushions 410, 412, 414 and 416 are inserted in the cushion case 115, the nursing mother pulls at the side panel 102 or cushion case to stretch the side panel to a height that conforms to the height of the four cushions or a height that allows the case to be closed. When a cushion is removed from the stack of the select number of cushions 400 in the cushion case 115 to decrease the height of the nursing pillow, the elasticized side panel 102 may relax or contract thus causing the side panel to decrease in height so that the cushion case height conforms to the height of the number of inserted cushions. For example, where four cushions 410, 412, 414, and 416 are inserted in the cushion case and up to three cushions are removed, the side panel relaxes and decreases in height and thus conforms or substantially conforms its height to the height of the inserted cushions.

As seen in FIGS. 5 and 9, cushion 410 and cushion 412 each comprise a wedge shaped side cross section and cushion 414 and cushion 416 each comprise a rectangular cross section. In the stack of cushions depicted, cushions 410 and 412 having a wedge shaped cross section are arranged one on top of the other to together form a rectangularly shaped side cross section that fits within the cushion case. Cushion 410 has, for example, a height $x_1$ of 2.5 inches at one side of the wedge shaped cross section and has, for example, a height $x_2$ of 0.5 inches at another side of the wedge shaped cross section. Cushion 412 has, for example, a height $x_3$ of 2.5 inches at one side of the wedge shaped cross section and has, for example a height $x_4$ of 0.5 inches at another side of the wedge shaped cross section. Thus, in combination cushions 410 and 412 and have a height $x_5$ of 3 inches and a rectangular cross section. Cushion 414 has for example a height $x_6$ of 1 inch. Cushion 416 has for example a height $x_7$ of 1.5 inches. In this example, all of the cushions together have a total height Xs of 5.5 inches.

In other examples, different sizes and/or shapes and configurations of cushions may be used. In order for the elasticized side panel height to conform its height to a height of any number of the select number of cushions, the side panel of the nursing pillow is sized and configured for conformation of height with any number of the selected number and height of cushions insertable within the cushion case.

Figure 7:
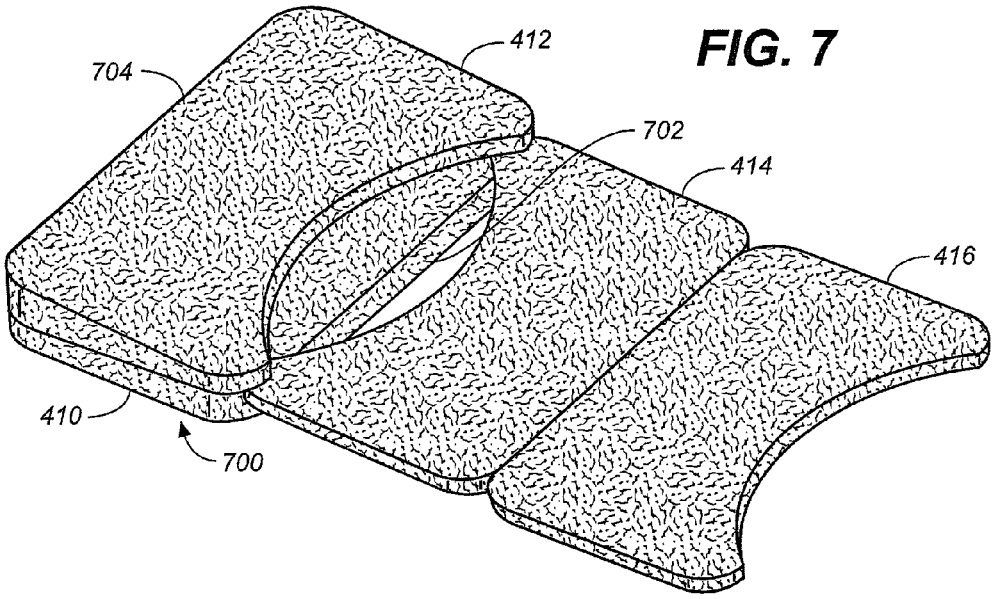
FIG. 7 is a perspective view of an arrangement of cushions of the nursing pillow of FIG. 4.
Figure 8:
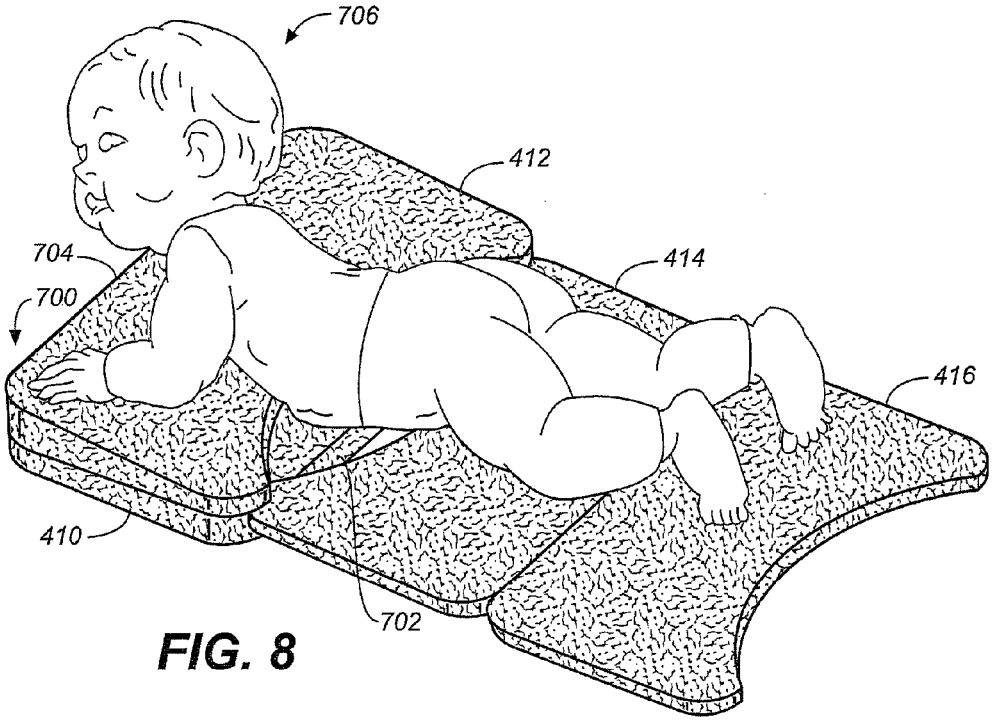
FIG. 8 is a perspective view of a baby on the arrangement of cushions of FIG. 7.

When the nursing pillow is not being used for nursing, the cushions may be arranged in a variety of different configurations outside of the cushion case. In the depicted example of FIGS. 7 and 8, the cushions 410 and 412 having a cross sectional wedge shape are arranged one on top of the other in a wedge structure 700. Cushion 410 is arranged on the bottom with its straight edge 702 side on an opposite side of a straight edge side 704 of cushion 412 when cushion 412 is placed on top. When a baby 706 or child rests his or her head or body on the two cushions or wedge structure 700, the baby or child's head or body is elevated by the wedge structure wedge structure 700. This allows a baby or child to rest more comfortably after eating and allows for easier breathing and digestion. Further, having the baby or child's head elevated on the wedge structure 700 helps reduce nasal congestion. Additionally, such an arrangement allows for "tummy time" for an infant, which helps in strengthening muscles. In another embodiment, only one cushion having a wedge shaped cross section is used to provide a wedge structure on which a baby or child may rest or elevate his or her head.

Cushions 414 and 416 may be arranged adjacent to the wedge structure and cushion is arranged adjacent to the wedge structure. This arrangement provides a cushioned surface upon which the baby 706 or child may rest his or her body.

Figure 6:
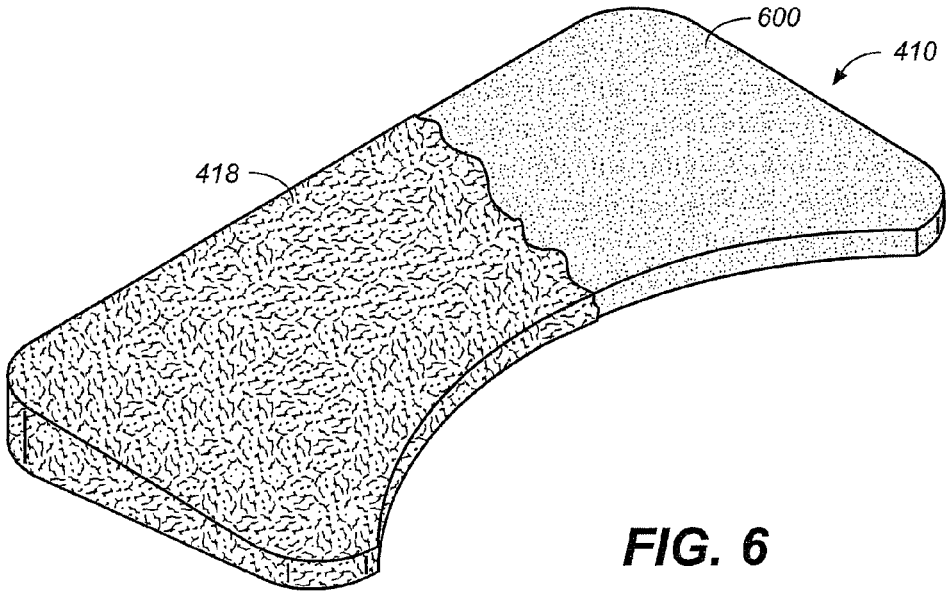
FIG. 6 is a perspective and partial cutaway view of a cushion of the nursing pillow of FIG. 4.

With reference to FIG. 4, each cushion 410, 412, 414 and 416 is shown covered with a cushion cover 418, 420, 422 and 424, respectively. In other embodiments, cushion covers are not used. With reference to FIG. 6, cushion 410 is shown with the cover 418 partially removed to show the underlying material 600 of the cushion. Each cushion cover is a removable and washable case used to cover the underlying cushion material, for example foam 600. The cushion cover is made of a material that is safe for contact with an infant or child. For example, it comprises a cotton material. In a preferred embodiment, all of the cushions are covered with a cover comprised of a material that is safe for contact with an infant, removable and washable. This prevents an infant from making contact with a cushion material, for example foam, which could pose a choking hazard for other hazard.

In another example, when the nursing pillow is not being used for nursing, one or more of the cushions 410, 412, 414, and 416 may be used as pregnancy side support pillow for a woman during pregnancy. For example, when laying on her side, a pregnant woman may position a wedged shaped cushion 410 or 412 next to her. A curved peripheral portion of the cushion is positioned nearest to her allowing her to rest her stomach on the cushion for support.

It is understood that the invention is not to be limited to the description herein. For example, any desired number of cushions may be used within the nursing pillow. Further, the cushions may comprise different shapes and heights from those depicted herein.

What is claimed is:

1. A nursing pillow, comprising:

a select number of cushions, including first, second and third cushions, each cushion having an upper surface and a lower surface and a contoured peripheral portion for encompassing some of the mid-section of a torso of a user, the first and second cushions having a wedge shaped cross section, the first cushion being flat from side to side on its upper surface and having an inclined lower surface relative to its upper surface, the second cushion being flat from side to side on its lower surface and having an inclined upper surface relative to its lower surface and a third cushion having a rectangularly shaped cross section and being flat from side to side on its upper surface and its lower surface; and a cushion case having a pocket within which the select number of cushions are stackable and a pocket opening within which the stackable cushions are insertable into and removable from the pocket, the first cushion stackable on the second cushion in the cushion case with the inclined lower surface of the first cushion resting on the inclined upper surface of the second cushion, the first and second cushions together forming a rectangularly shaped cross section from the contoured peripheral portion to an opposing edge, the cushion case having an elasticized side panel about a perimeter of the cushion case, wherein the elasticized side panel allows for the cushion case to conform its height to a height of any number of the select number of cushions inserted within the pocket.

2. The nursing pillow of claim 1, wherein the elasticized panel comprises lycra or spandex.

3. The nursing pillow of claim 1 wherein the elasticized side panel comprises a front surface, a rear surface and two side surfaces of the cushion case.

4. The nursing pillow of claim 1 wherein the entire side panel is elasticized.

5. The nursing pillow of claim 1, wherein the cushion case further comprises an upper surface and a lower surface wherein a shape of the upper surface and the lower surface are the same as a shape of an upper surface and a lower surface of each of the select number of cushions.

6. The nursing pillow of claim 1, wherein the cushion case further comprises a curved portion for encompassing some of the mid-section of a torso of a user.

7. The nursing pillow of claim 1, wherein the cushion case is comprised of a fabric.

8. The nursing pillow of claim 1, wherein each of the stackable cushions has a removable cover.

9. The nursing pillow of claim 1, wherein each of the stackable cushions is comprised of foam covered with a washable cover.

10. The nursing pillow of claim 1, wherein the cushions having a wedge cross-section are arrangeable outside of the cushion case on top of one another with cutouts on opposing ends of the arrangement forming an inclined head and/or body support.

11. The nursing pillow of claim 1 wherein there is a fourth cushion having a rectangular shaped cross section and a flat upper surface from side to side and a flat lower surface from side to side.

12. The nursing pillow of claim 1 further comprising a lumbar pillow opposing a rear surface of the cushion case and removably connected to the cushion case by a strap.

13. The nursing pillow of claim 1, further comprising a storage pocket disposed on a side surface of the elasticized side panel.

* * * * *